US008764253B2

(12) United States Patent
Ko et al.

(10) Patent No.: US 8,764,253 B2
(45) Date of Patent: Jul. 1, 2014

(54) HANDS-FREE MULTI-POSITIONAL TASK LIGHT AND METHOD OF USE THEREOF

(76) Inventors: Wai-Shing Peter Ko, Peachtree City, GA (US); Jon Eric Gibson, Oxford, GA (US)

( * ) Notice: Subject to any disclaimer, the term of this patent is extended or adjusted under 35 U.S.C. 154(b) by 566 days.

(21) Appl. No.: 12/723,525

(22) Filed: Mar. 12, 2010

(65) Prior Publication Data

US 2011/0222274 A1 Sep. 15, 2011

(51) Int. Cl.
*F21V 21/00* (2006.01)

(52) U.S. Cl.
USPC ..... 362/396; 362/190; 362/191; 362/249.02; 362/368; 362/370

(58) Field of Classification Search
USPC ..... 362/396, 190–191, 249.02, 368, 370
See application file for complete search history.

(56) References Cited

U.S. PATENT DOCUMENTS

| | | | | |
|---|---|---|---|---|
| 1,699,927 | A * | 1/1929 | Stearns | 362/199 |
| 1,722,773 | A * | 7/1929 | Stewart | 248/229.16 |
| 4,288,848 | A | 9/1981 | Fido | |
| 4,376,965 | A | 3/1983 | Bacevius | |
| 4,506,317 | A | 3/1985 | Duddy | |
| 4,895,329 | A * | 1/1990 | Sloan | 248/229.16 |
| 5,448,463 | A | 9/1995 | Leen | |
| 5,465,196 | A | 11/1995 | Hasenberg et al. | |
| 5,541,822 | A | 7/1996 | Bamber | |
| 5,548,496 | A | 8/1996 | Hart et al. | |
| 5,667,185 | A | 9/1997 | Maglica | |
| 5,690,416 | A | 11/1997 | Gennep | |
| 5,823,657 | A | 10/1998 | Price et al. | |
| 6,540,184 | B2 | 4/2003 | Thaxton | |
| 6,585,400 | B2 | 7/2003 | Leen | |
| 6,860,622 | B1 | 3/2005 | Rivers | |
| 7,040,783 | B1 | 5/2006 | Christianson | |
| 7,111,965 | B2 * | 9/2006 | Hsu | 362/396 |
| 7,246,927 | B2 * | 7/2007 | Wikle et al. | 362/396 |
| 7,290,898 | B2 | 11/2007 | Martin et al. | |
| D590,540 | S | 4/2009 | Ko | |

* cited by examiner

*Primary Examiner* — Sean Gramling

(57) ABSTRACT

A hands-free multi-positional task light having an elongated light emitting portion utilizing one or more fluorescent tubes and/or light emitting diodes, a wide retractable and fully rotatable mounting hook, a free-standing base capable of maintaining stability when positioned on surfaces up to 20 degrees from horizontal, and a mounting clamp attached via a ball and socket joint serving as a mounting method, a means to attach alternate mounting devices such as magnets or additional hooks, a makeshift base, or a stabilizing weight while providing two degrees of movement and a clamp band providing a third degree of movement for nearly unlimited aiming for hands-free use.

13 Claims, 14 Drawing Sheets

400

600

HANDS-FREE MULTI-POSITIONAL TASK LIGHT AND METHOD OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to lighting devices, and more specifically to a hands-free multi-positional task light and method of use thereof, wherein the task light mounts to an object or rests upon a surface, and wherein the task light may be positioned and aimed to illuminate a selected task or work area.

2. Description of Related Art

Supplemental lighting for various tasks and appropriate luminaires that provide this light exist. Common forms of portable task luminaires include the use of a bulb-shaped incandescent lamp surrounded by a guard to protect the lamp from impact, or a reflector to redirect and focus the light to the desired area, or the use of both a reflector and enclosure to achieve both goals, and a handle for use in directing the light towards the desired area.

With the advent of LED (light emitting diode) sources having a high degree of directionality to the emitted light, the large reflectors can be eliminated reducing the overall profile of the luminaire but requiring an array of LED sources to achieve the desired amount of light. The array of LEDs can be contained in a clear, sealed polymeric chamber or tube for protection. This tube or chamber is often elongated in shape and extended or contiguous with another element of similar profile to form a handle for manual positioning.

One deficiency in these designs is their requirement of being hand-held which deprives the use of one hand for the completion of the intended task. As many tasks require the use of two hands, a number of hands-free solutions have been attempted including the use of a hanging hook to suspend the luminaire or incorporating a flattened portion onto the handle enabling the unit to rest upon a flat surface for some degree of hands-free operation.

Other forms of hands-free mounting have been developed including the use of magnets for mounting onto ferrous metal surfaces and assorted styles of clamps which increase mounting options.

Available LED task lights utilize a flat portion of the handle (usually at the end of the handle) to achieve some degree of hands-free operation. The disadvantages of such a design include the instability of the luminaire when set upright on a flat horizontal surface. This instability is due to the very high center of gravity relative to the dimensions of the flat area of the handle in contact with the horizontal surface. Further disadvantages include the inability to remain upright when placed on sloped surfaces and the inability to direct the light towards the desired task once positioned. Similarly available hanging hooks can only suspend the light in a vertical manner, which eliminates the ability to aim the light towards a specific task. Furthermore, the combination of the elongated LED array with the handle forms an elongated product that is less convenient to transport and difficult to store when not in use.

More advanced designs have multiple degrees of freedom of motion through the use of goose-necks, hinge joints, rotating collars and ball joints that enable a light to be positioned and aimed directly towards a task once mounted. These designs are significantly more complex, employing additional components, moving parts and connections which increase the size, weight and cost. Many of these designs compromise on their functionality due to these increases and will not retain all three of the desirable mounting alternatives which include;

free-standing on a flat or sloped surface,
clamped to some fixed object, and
hand-held.

One such example of a design that does not include all three of these desirable mounting alternatives is U.S. Pat. No. 5,690,416 by Van Gennep that describes a bulky assembly consisting of vice grip pliers, an attached ball joint and a three-ring collar used to hold a flashlight. As stated above, devices such as these are not intuitively free-standing and are certainly not stable when placed on sloped surfaces.

There are, however, a few notable examples where devices are described that attempt to provide as many of the desirable mounting alternatives as possible despite the increased size, weight and cost such as U.S. Pat. No. 7,290,898 by Martin et al. where a self-locking, ratcheting clamp using fold-out finger clamps is disclosed that is incorporated into the base of the light. Even products such as this have limitations and disadvantages for example the device described by Martin et al. can not be mounted to objects with restricted access due to the bulk of the clamping mechanism itself and it has no way of stabilizing itself or otherwise adapting to sloped surfaces. Another problem with designs that combine the functions of the handle with the function of the base is that the physical requirements for each function differ significantly. In order to form a base with solid footing, the size of the footprint of the base should be as large as possible in both length and width, and the edges should be angular and well defined, but the requirements for a comfortable handle are to be smaller in diameter, more elongated in shape with smooth rounded corners. For these reasons the design described by Martin et al. is still suboptimal. Though there are designs that attempt to combine all three desirable task light mounting alternatives, none have successfully integrated an ergonomic and functional clamp design with a stable, free-standing, hands-free multi-positional task light.

BRIEF SUMMARY OF THE INVENTION

It is with the above described that self powered, rechargeable, portable luminaire providing multiple options of hands-free positioning and aiming which enable the operator to illuminate the task area and still use both hands to perform a given work function. The portable lamp assembly has an LED array or a fluorescent lamp contained within a transparent enclosure. The lamp assembly has a stable base comprising a push-button switch and a battery recharging receptacle which allows free-standing and hands-free operation even on rough, uneven or sloped surfaces up to 20 degrees from horizontal. The lamp assembly also has a substantial clamp comprising two pieces of metal or rigid plastic springably connected at a common hinge point suitable for clamping to objects of indeterminate shape and size pivotally and frictionally connected to the luminaire in a manner to facilitate precise aiming control and at least two degrees of freedom of movement. When mounted to the outer housing of the hands-free multi-positional task light with a clamp band as described in the preferred embodiments, a third degree of freedom of movement is accomplished. Another function of this clamp is to provide a means for connecting additional mounting hardware such as magnets or secondary hooks to the luminaire. This clamp should also facilitate the movement of the center of gravity of the entire hands-free multi-positional task light in order to further stabilize said hands-free multi-positional task light when placed on uneven or sloped surfaces in excess of 20 degree from horizontal. The lamp assembly additionally has a wide, retractable, fully rotatable metal or plastic mounting hook positioned off-center to the cap of the luminaire allowing suspended mounting from any overhead pipe, line or cable or mounted to any physical ledge or other horizontal surface upon which the end of the hook can rest.

In addition to the primary object of the invention it is also an object of the invention to produce a hands-free multi-positional task light that:

- can be used in a hands free manner enabling the user to use two hands when working on tasks,
- can be hand-held if desired by grasping the ergonomic clamp handles and directing the light where desired,
- is capable of using high-efficiency light sources in the design, including LEDs (light emitting diodes) or fluorescent lamps,
- includes a clamp with a protective cover to prevent scratching of the object being mounted to,
- includes a clamp that can securely mount onto cylindrical objects,
- includes a clamp that is capable of housing a strong magnet capable of supporting the hands-free multi-positional task light,
- includes a clamp that is capable of securing an additional hanging hook
- includes a clamp that contains a slotted hole for mounting directly onto a protruding nail or screw,
- includes a clamp with significant enough mass to shift the center of gravity of the hands-free multi-positional task light thereby increasing stability on highly sloped mounting surfaces,
- includes a clamp with a friction pad to increase stability when urged in contact with sloped mounting surfaces,
- includes a clamp with a ball and socket joint providing freedom of movement in multiple orientations,
- is capable of longer run times than standard flashlights,
- uses a colored LED indicator light to show when the rechargeable battery is fully charged,
- uses pin-and-anchor mechanism to open the unit for battery maintenance,
- has multiple brightness levels,
- includes a hanging hook with a protective cover to prevent scratching of the surface or object being mounted to,
- includes a wide hanging hook for mounting to wide objects like the top of a door,
- includes a fully rotational hanging hook for directing the light regardless of the orientation of the mounting support,
- includes an offset hanging hook for mounting to 90 degree corners,
- is rugged in construction,
- is reliable and virtually maintenance free, and
- is cost effective from both a manufacturer's and consumer's point of view.

These and other features and advantages of the present invention will become apparent from the subsequent detailed descriptions of the selected preferred embodiments and the alternate embodiment and the appended claims taken in conjunction with the accompanying drawings.

BRIEF DESCRIPTION OF THE SEVERAL VIEWS OF THE DRAWINGS

The invention is diagrammatically illustrated by way of example in the accompanying drawings in which.

DETAILED DESCRIPTION OF THE PREFERRED AND ALTERNATE EMBODIMENTS OF THE INVENTION

In describing the various preferred and alternate embodiments of the present invention, as illustrated in FIGS. 1A-8C, specific terminology is employed for the sake of clarity. The invention, however, is not intended to be limited to the specific terminology so selected, and it is to be understood that each specific element includes all technical equivalents that operate in a similar manner to accomplish similar functions.

Figure 1A:
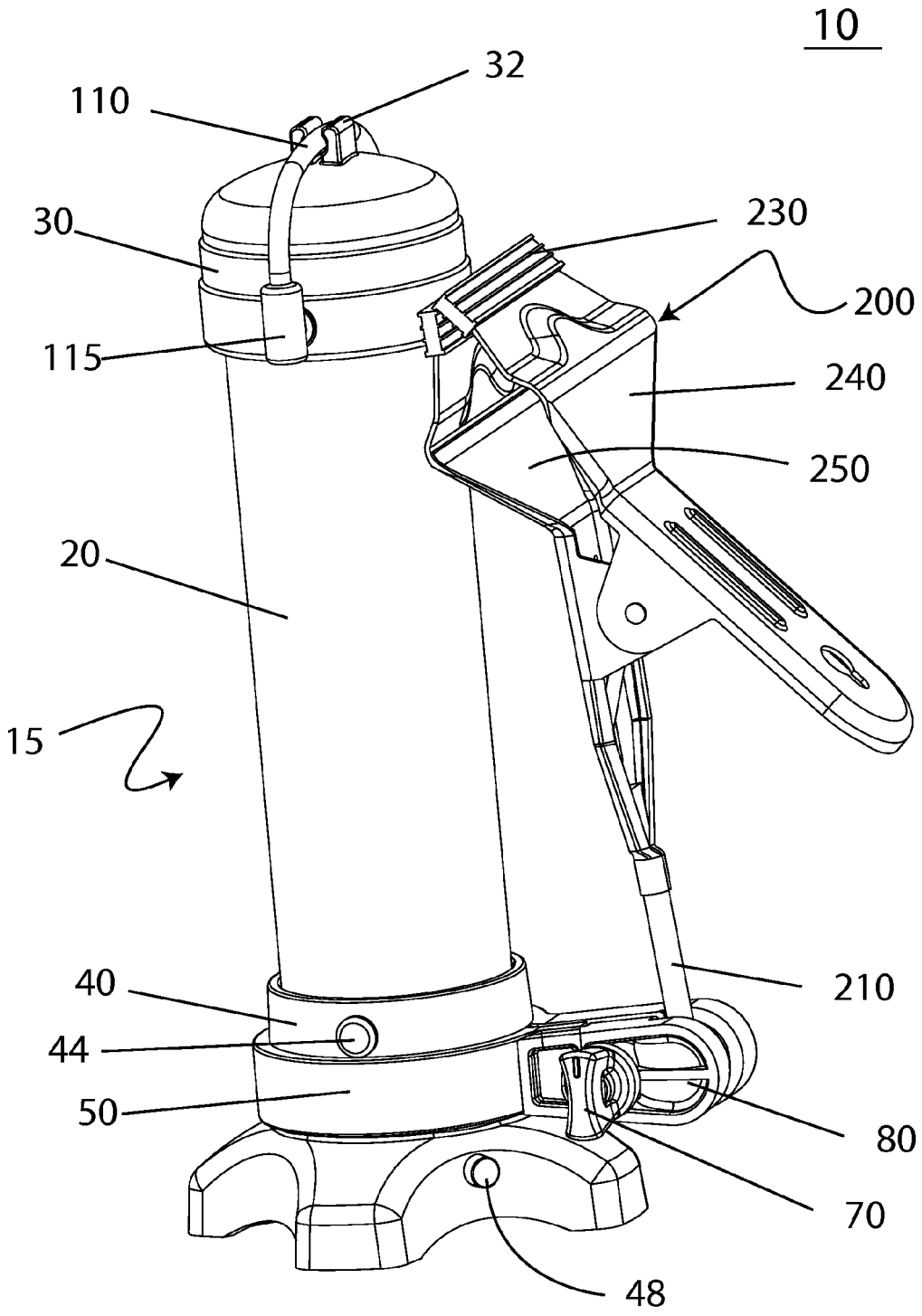
FIG. 1A is a perspective view of the invention, a free-standing and multi-positional task light.
Figure 1B:
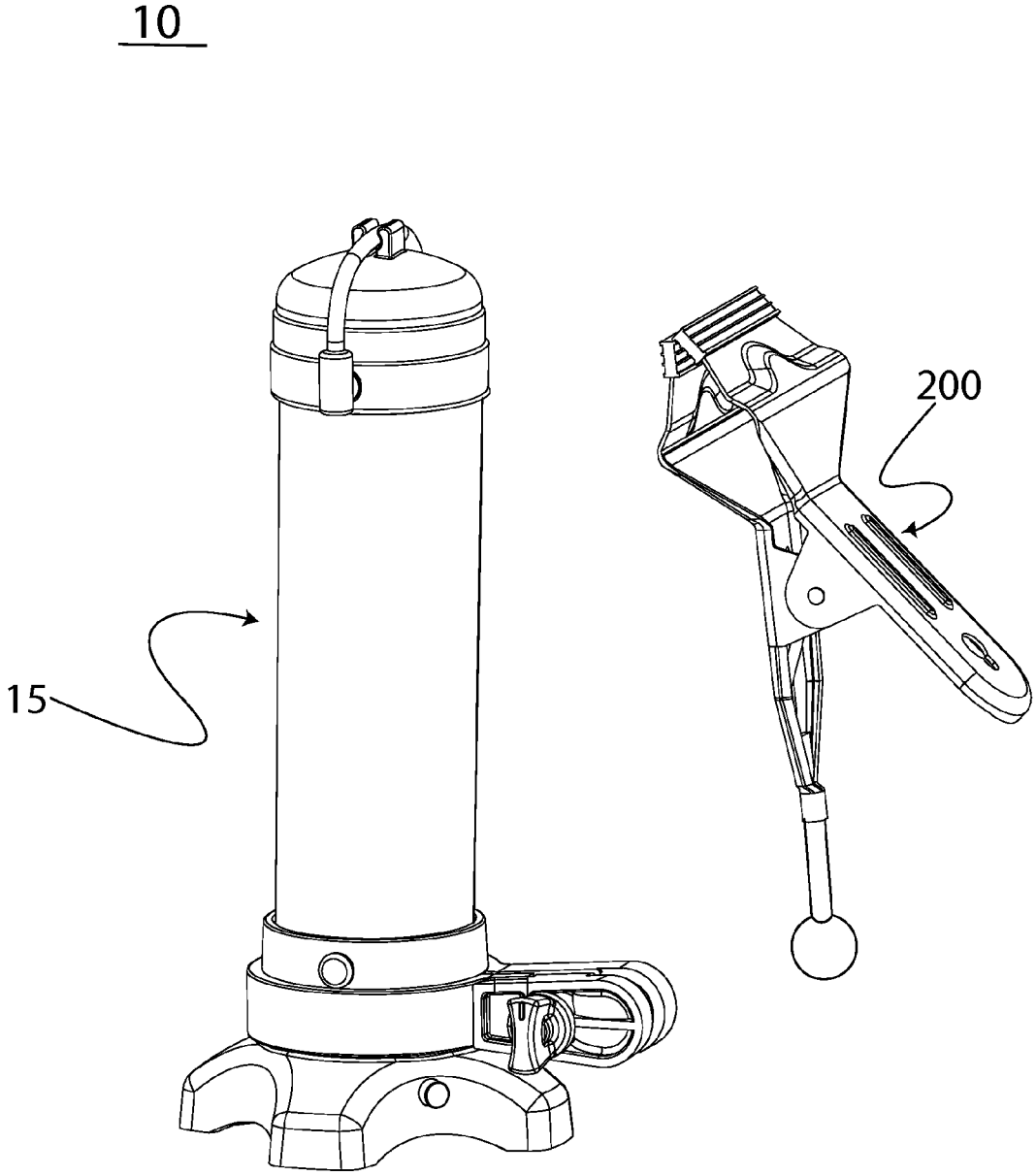
FIG. 1B is a perspective view of the invention where the clamp 200 separate from the primary light module 15.

FIG. 1B is a perspective view taken from the front and right side of a hands-free multi-positional task light 10 according to the invention. It has a primary light module 15 and a clamp assembly 200 which is pivotably and frictionally attached to the primary light module.

Figure 2A:
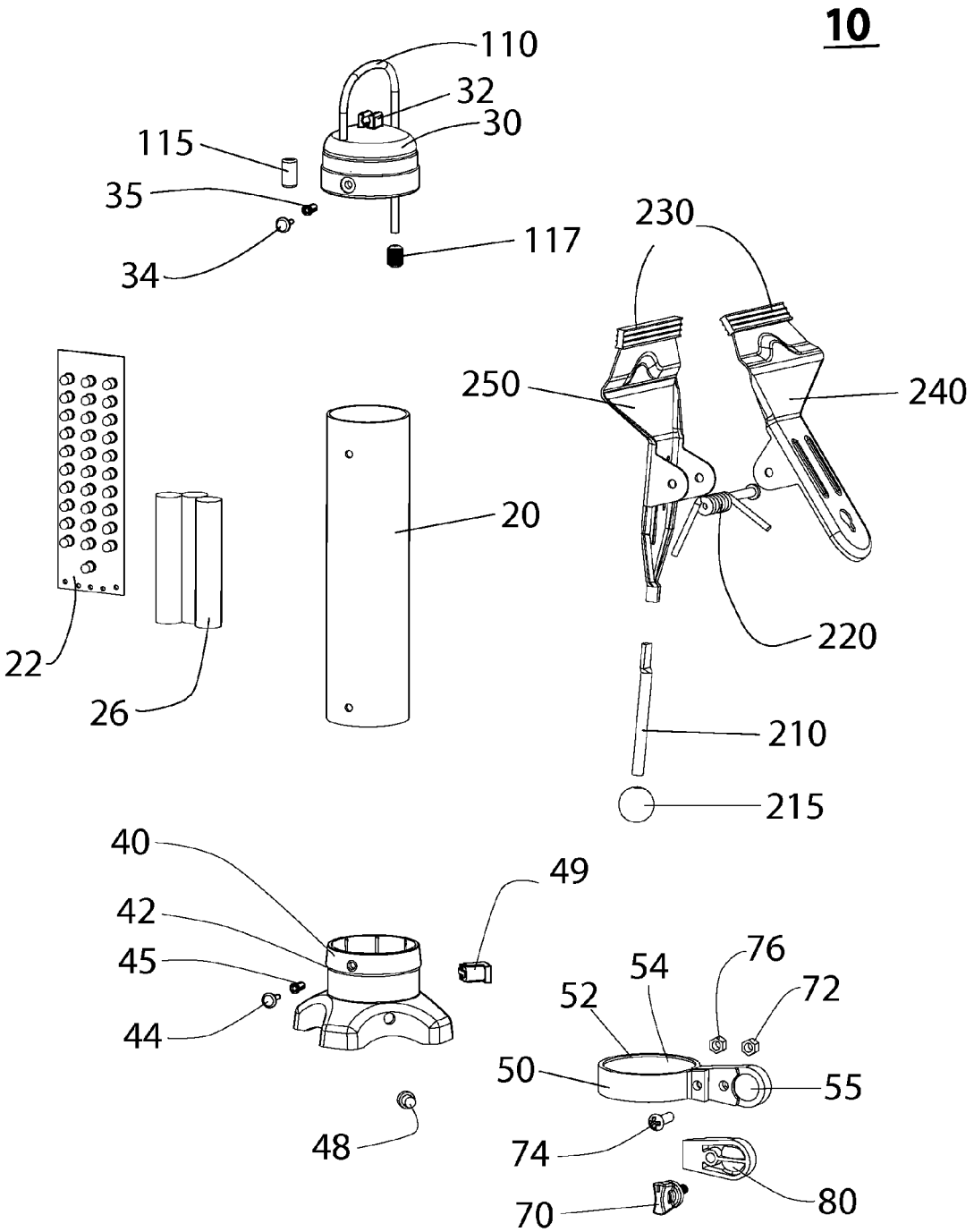
FIG. 2A is an exploded view of the invention.
Figure 2B:
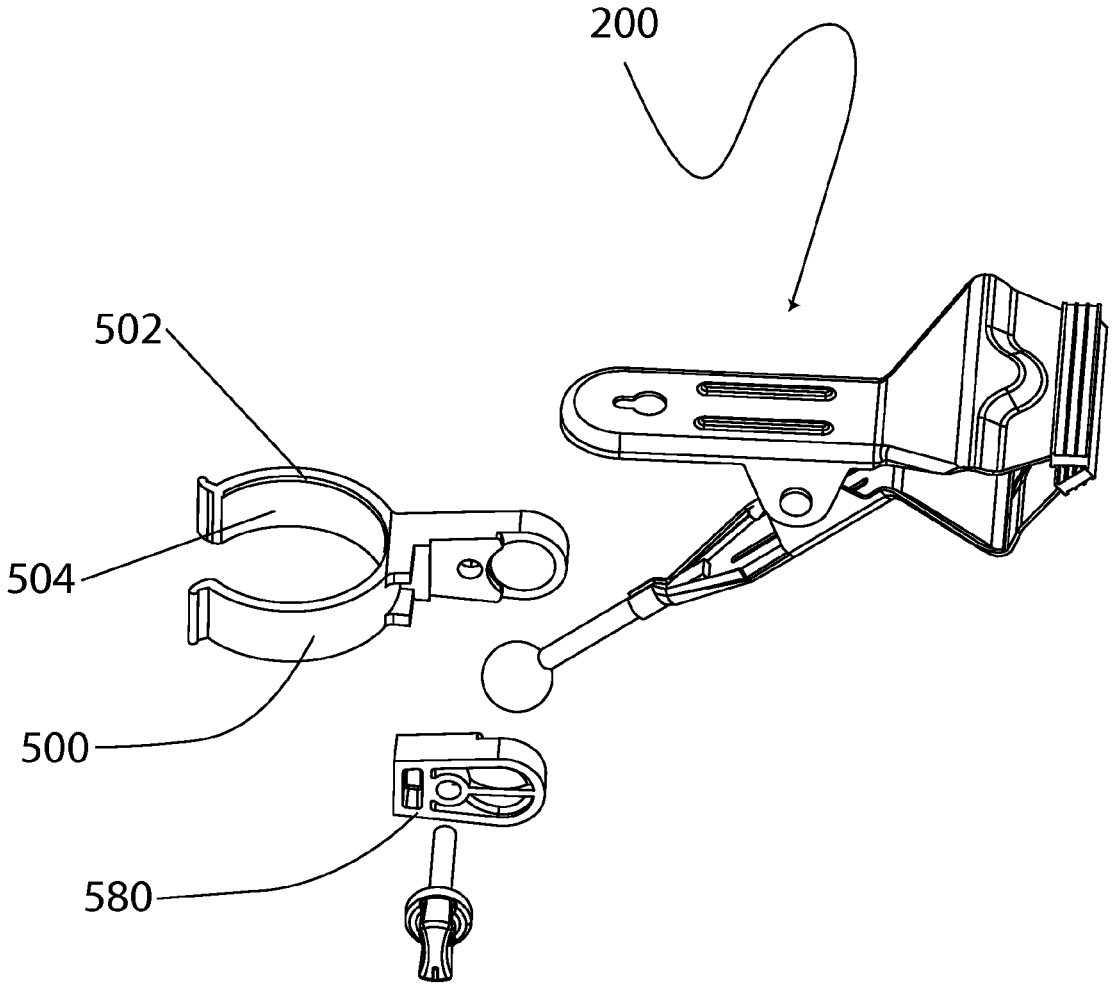
FIG. 2B is a perspective view showing a c-shaped clamp which is an alternate embodiment of the clamp band 50 in the invention.
Figure 2C:
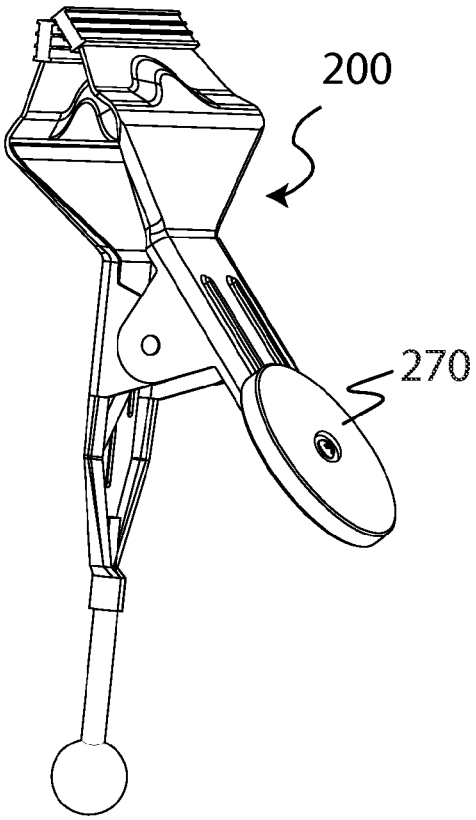
FIG. 2C is a perspective view showing clamp 200 with a magnet affixed to the clamp.
Figure 2D:
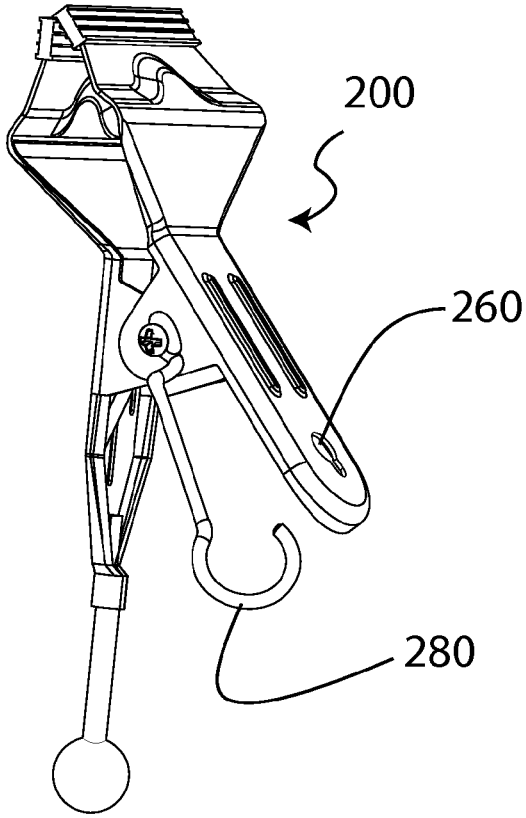
FIG. 2D is a perspective view showing clamp 200 with a secondary hook affixed to the clamp.
Figure 5A:
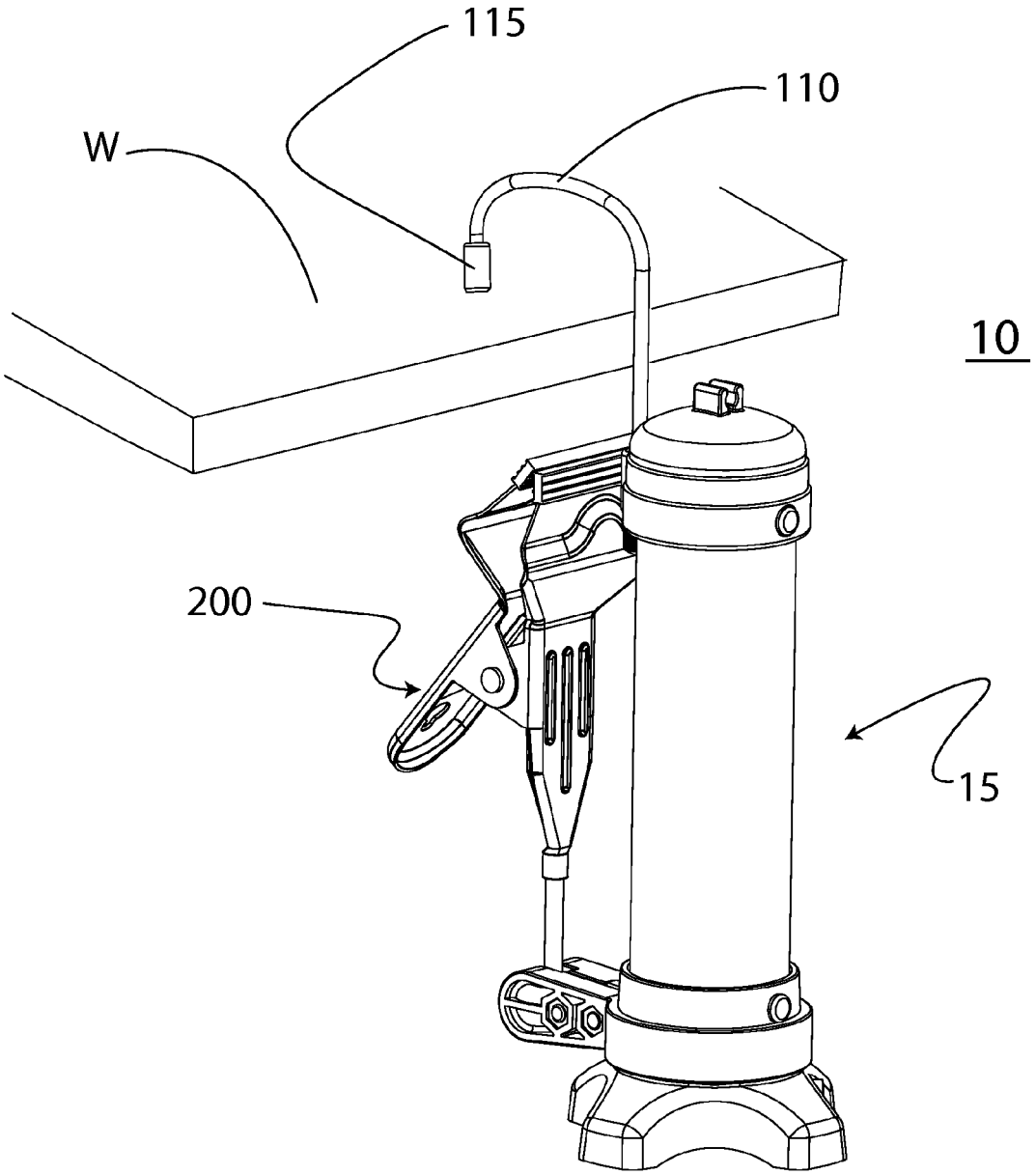
FIG. 5A is a perspective view of the invention mounted to a flat surface by means of the hanging hook.
Figure 5B:
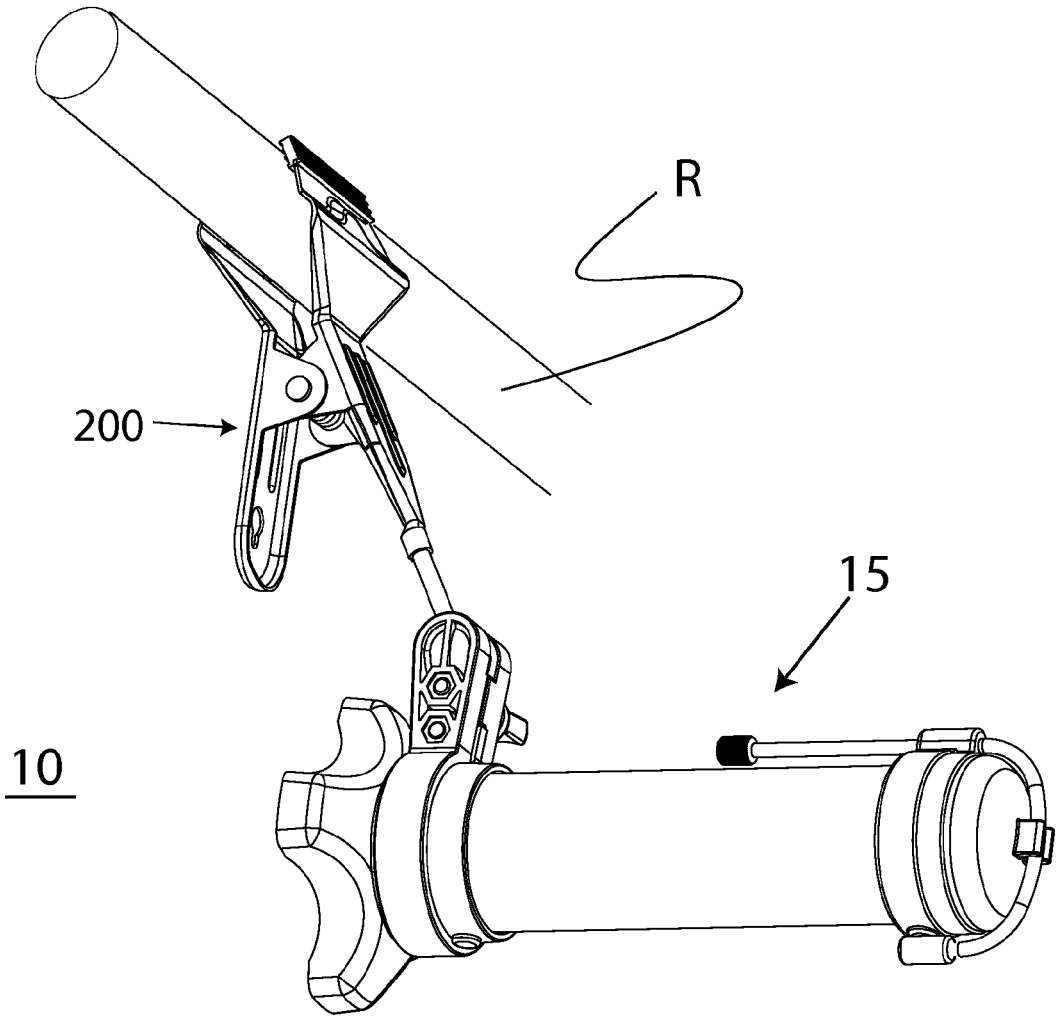
FIG. 5B is a perspective view of the invention mounted to a cylindrical object by means of the clamp.

The clamp 200 shown in FIG. 1A and with further detail in FIG. 2A has a fixed clamp leg 250 and a pivoting clamp leg 240 hingedly joined at a clamp hinge spring 220. As shown in FIGS. 5B and 5A, the shape of these clamp legs is such that they can grip around a cylindrical shape like a pipe or tube as well as grip onto a flat surface of varying thicknesses with sufficient strength to support and hold steady said hands-free multi-positional task light 10. Each clamp leg has a clamp jaw protector 230 at its distal end to protect the mounting surface from scratches, and the proximal end of the fixed clamp leg 250 is fixedly connected to the clamp extension rod 210 which is in turn fixedly connected to the clamp ball 215. As shown in FIGS. 2B, 2C and 2D the pivoting clamp leg 240 contains a keyhole slot 260 to which an alternate mounting device such as a strong magnet 270 or a secondary hanging hook 280 can be connected. FIG. 2D shows another means of connecting the secondary hanging hook 270 at the clamp hinge.

In the first preferred embodiment shown on FIGS. 1A and 2A, the clamp ball 215 is frictionally held captive by a friction surface 55 of a clamp band 50 and a similar surface on a friction plate 80. These two friction surfaces 55 are urged together and around said clamp ball 215 by tightening a friction tightening knob 70 which is engaged with a friction tightening nut 72. This assembly forms a ball and socket joint allowing pitch, roll and yaw of said clamp 200. The clamp band 50 is further connected to the primary light module 15 by encircling a base 40 so that a clamp band lip 52 engages slidably within a grooved guide 42 in said base 40 allowing free rotation of said base 40 within said clamp band 50.

Figure 3A:
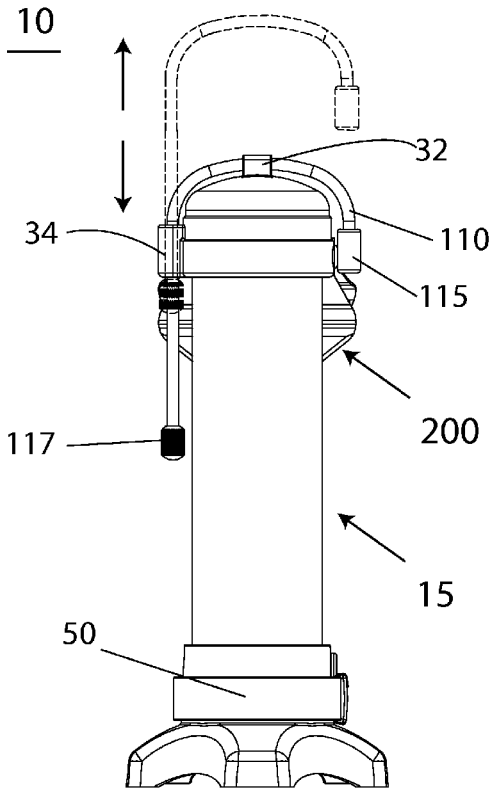
FIG. 3A is a side elevational view of the invention illustrating the location of the retractable hanging hook in retaining position.
Figure 3B:
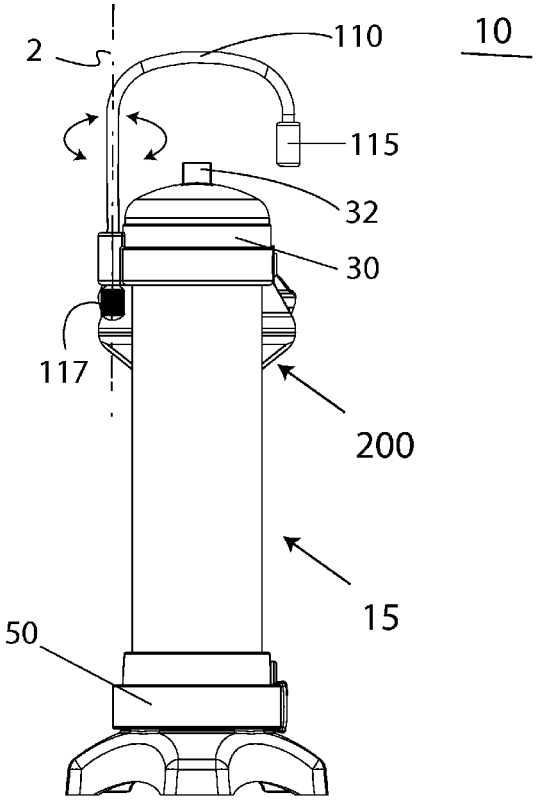
FIG. 3B is a side elevational view of the invention illustrating the release of the retractable hanging hook from the retaining position in a up and down motion and the hook can rotate 360 degree around the axis once it is released.
Figure 3C:
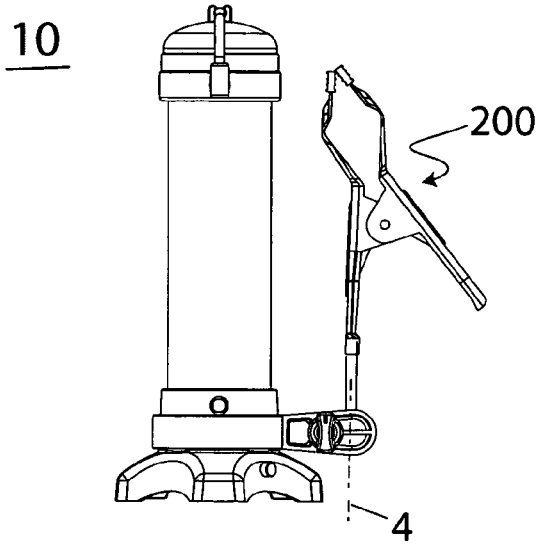
FIG. 3C is a side elevational view of the invention illustrating the clamp connected to the clamp band with a ball and socket joint.
Figure 3D:
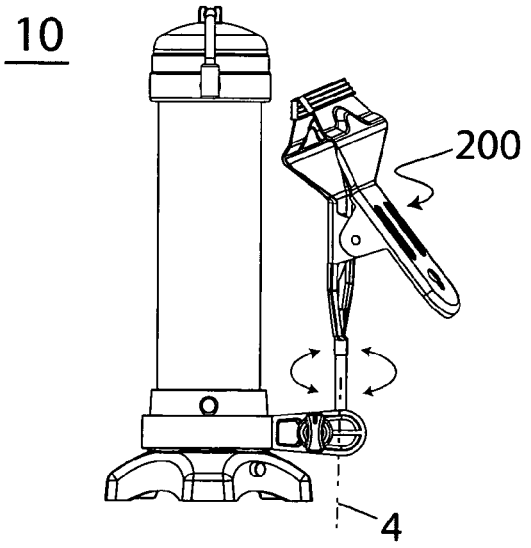
FIG. 3D is a side elevational view of the invention illustrating the first degree movement of the clamp, up to 360 degrees around the axis with the ball and socket joint.
Figure 3E:
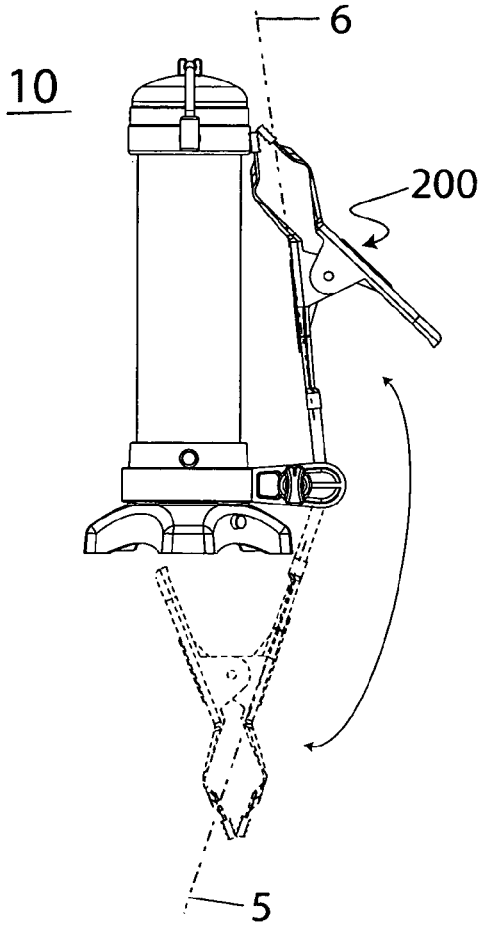
FIG. 3E is a side elevational view of the invention illustrating the second degree movement of the clamp, up to 200 degrees with the ball and socket joint connected to the clamp band.
Figure 3F:
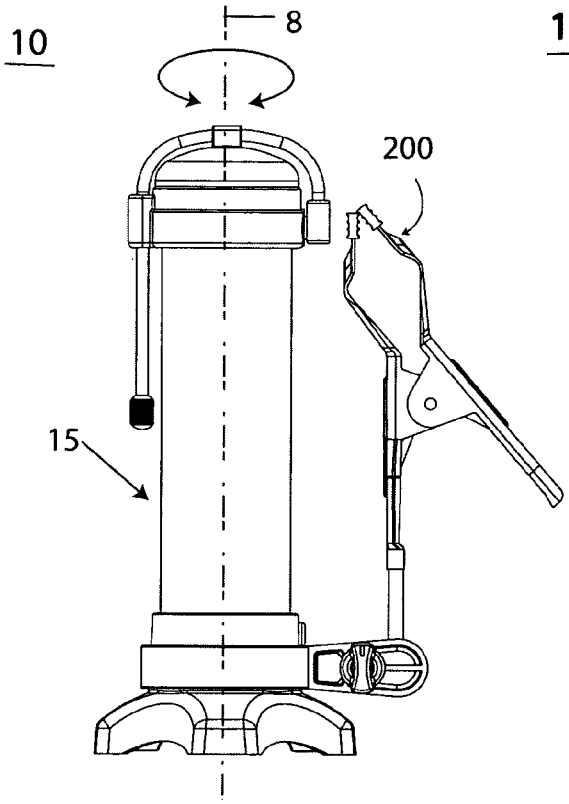
FIG. 3F is a side elevational view of the invention illustrating the rotating axis of the light fixture in respect to the clamp band up to 360 degree.
Figure 3G:
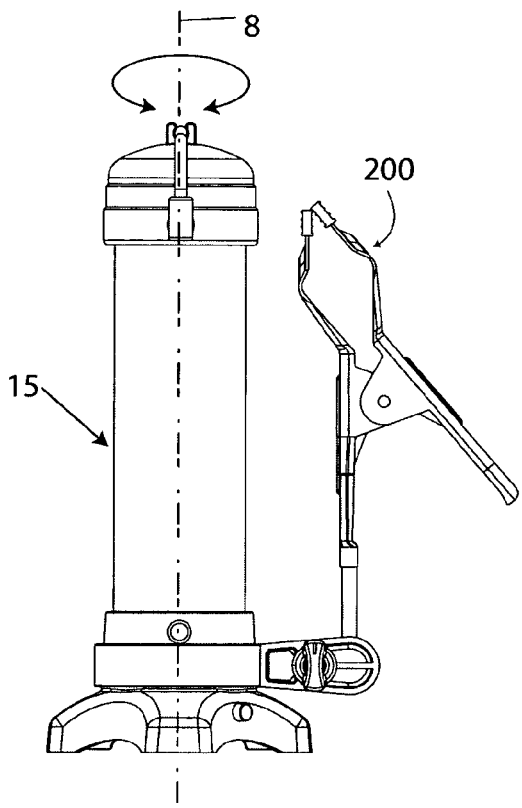
FIG. 3G is a side elevational view of the invention illustrating the example of the rotation that the light emitting body of the invention rotated 90 degree from FIG. 3F in respect to the clamp band.

The amplitudes of movement of the first preferred embodiment is further shown in FIG. 3D which shows the rotational axis of clamp 200 and FIG. 3E showing the extent of movement of clamp 200 from the lowest pivot location 5 to the highest pivot location 6. The rotational movement of the clamp band is shown in FIG. 3F and FIG. 3G where the primary light module 15 rotates freely within the clamp band 50 around a primary lamp module rotational axis 8. This rotational movement can be frictionally restricted by increasing the tightness of said clamp band 50 which can be adjusted by tightening a clamp band fastener 74 engaged with a clamp band fastener nut 76 which pulls the two ends of said clamp band 50 together, thus constricting the diameter of the clamp band 50 urging it tighter against said base 40.

The primary light module 15 shown in FIGS. 1A and 2A is comprised of the base 40, a translucent polymeric tube 20, a light source 22, a battery 26, a top cap 30, a 4-position push-button switch 48, and a charging port 49. The light source 22 is shown as an array of LEDs (light emitting diodes) and a driver, but could comprise a fluorescent lamp and ballast. In the first preferred embodiment 10, the base 40 of the primary light module 15 is fixedly disposed to the translucent polymeric tube 20 by way of a base pin 44 and a base anchor 45. The translucent polymeric tube 20 is further fixedly disposed to the top cap 30 by way of a top cap pin 34 and top cap anchor 35.

FIG. 3A shows a wide metal hanging hook 110 which is rotatably and slidably disposed to the top cap 30 and is secured by a hook retention nut 117 on the proximal end of the hanging hook 110, and a scratch resistant cap 115 is fixedly disposed on the distal end of the hanging hook 110. When not in use, the hanging hook 110 can be retracted and secured in a hook retainer 32 located on top of the top cap. When the hanging hook is deployed as shown in FIG. 3B, the hanging hook 110 is extended upwards thus freeing it from the hook retainer 32 allowing free rotation of said hanging hook 110 to better mount to a mounting surface.

Figure 4A:
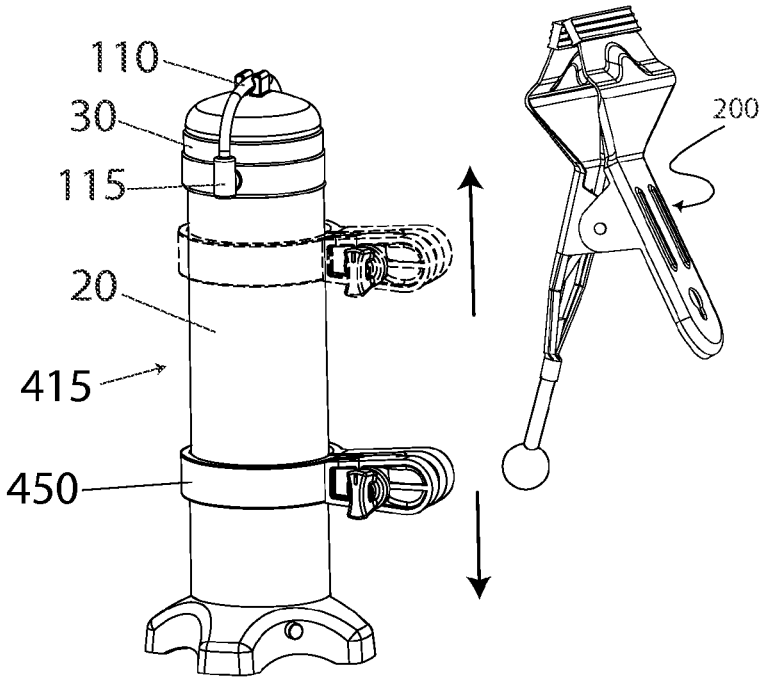
FIG. 4A is a perspective view of the second embodiment of the invention where the light emitting body of the housing goes over the base. The clamp band can have an additional degree of movement, moving up and down along the longitudinal axis of the light emitting body.

A second preferred embodiment 400 of the hands-free multi-positional task light 10 is shown in FIG. 4A comprising a clamp 200, and a primary light module 415 which is further comprised the translucent polymeric tube 20, said top cap 30, and a movable clamp band 450 which is slidably and rotatably attached to said translucent polymeric tube 20. The movable clamp band 450 is similar to the clamp band 50 described in the first preferred embodiment with the addition of a foam pad attached to the inner surface to enable a friction fit of the movable clamp band 450 to rotate around the translucent polymeric tube 20 and slide up and down the length of the translucent polymeric tube 20.

Figure 4B:
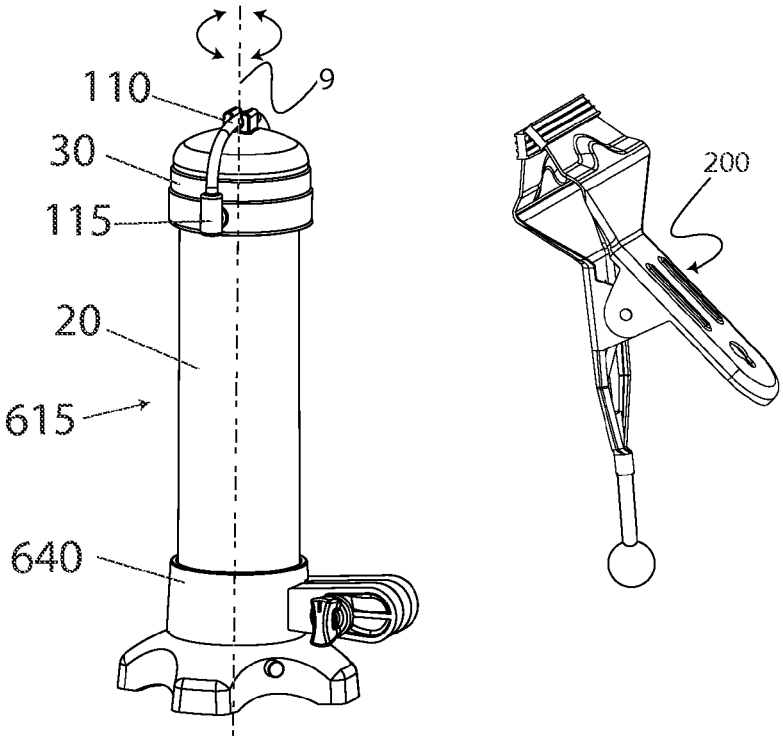
FIG. 4B is a perspective view of the third embodiment of the invention where a built-in ball joint socket is incorporated to the base of the light which can capture the ball joint of the clamp.

A third preferred embodiment 600 of the hands-free multi-positional task light 10 is shown in FIG. 4B comprising a clamp 200, and a primary light module 615 which further comprised of the top cap 30, the translucent polymeric tube 20, and a base with integrated ball socket 640. In this embodiment no clamp band is required due to the integration of the ball socket. In this third preferred embodiment 600 the translucent polymeric tube 20, is rotatably secured to the base with integrated ball socket 640 allowing the translucent polymeric tube 20 to rotate freely around rotational axis 9.

In an alternate embodiment of hands-free multi-positional task light 10 shown in FIG. 2B, the clamp band 50 could be replaced by a C-clamp connector 500 comprising of a c-clamp inner surface 504 and c-clamp lip 502 which are frictionally engaged with the base 40 and groove guide 42 respectively, and a c-clamp friction plate 580 which serves a similar function as the friction plate 80 in the first preferred embodiment.

Figure 5C:
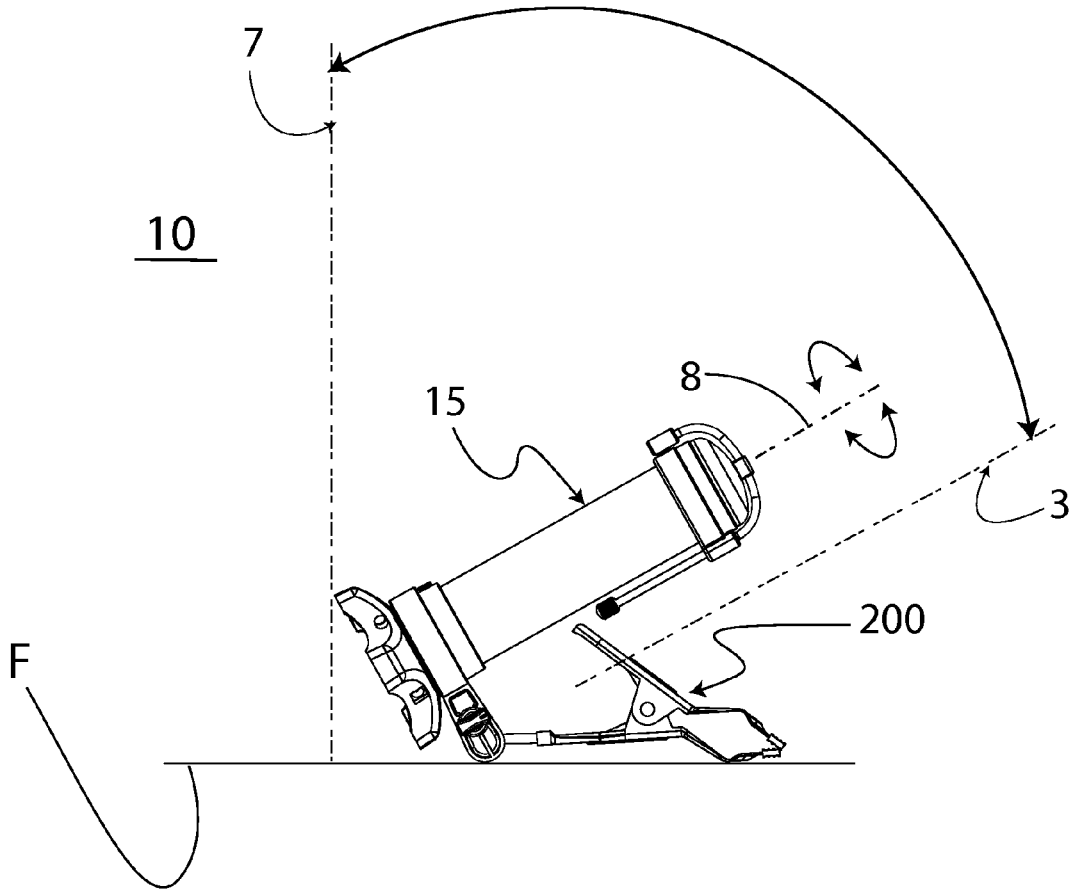
FIG. 5C is a side elevational view of the invention when the clamp and the tip of clamp band form a base on a level surface so the light emitting body can be aimed to any desired direction.

FIG. 5C shows a method of using the embodiment as a hands-free worklight when there are no nearby objects from which to mount the light using the hanging hook 110 or the clamp 200. The clamp 200 functions as a makeshift support upon which the primary light module 15 rests, with the widest portion of the fixed clamp leg 250 resting against the flat surface F such that the end of the protrusion on the base with integrated ball socket 640 can serve as the distal support. With this arrangement, the primary lamp module 15 can be aimed through a combination of rotation about the rotational axis 8, and pivoting at any angle between a tilted pivot position 3 and an upright pivot position 7.

Figure 6:
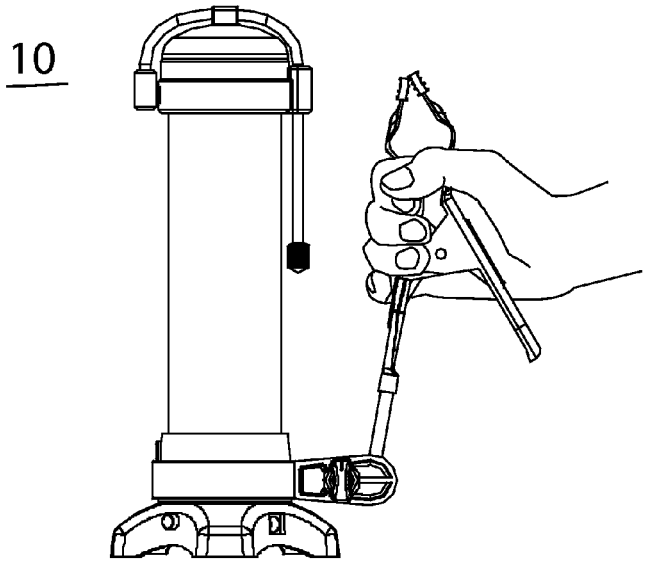
FIG. 6 is a side elevational view of the invention when the clamp is holding by hand. The overall height of the invention would be shorter than the typical hand held task light with handle.

The first preferred embodiment 10 of this invention can also be aimed manually by being held in the hand as seen in FIG. 6 which shows the clamp 200 being firmly grasped in a human hand. When held in this manner, the light emitted through the translucent polymeric tube 20 can be aimed through a combination of pivoting, or rotation at the ball and socket joint, through rotation of the primary light module 15 about its longitudinal axis 8 or through simple adjustments in the positioning of the hand holding the hands-free multi-positional task light 10.

Figure 7A:
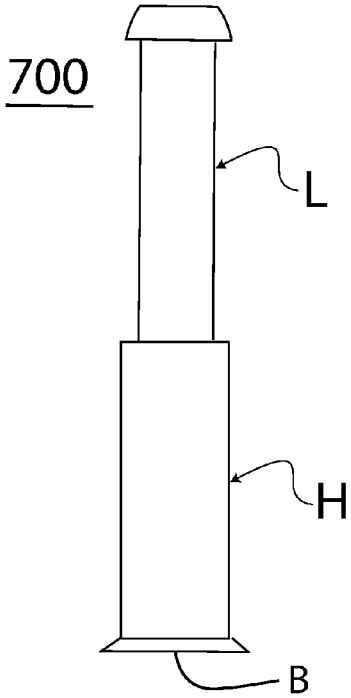
FIG. 7A is a side elevational view of a typical hand held task light consists of a light emitting body section and a handle section.
Figure 7B:
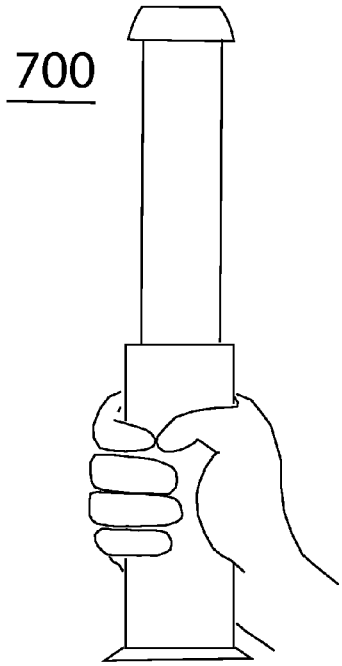
FIG. 7B is a side elevational view of the typical hand held task light holding by hand.
Figure 8A:
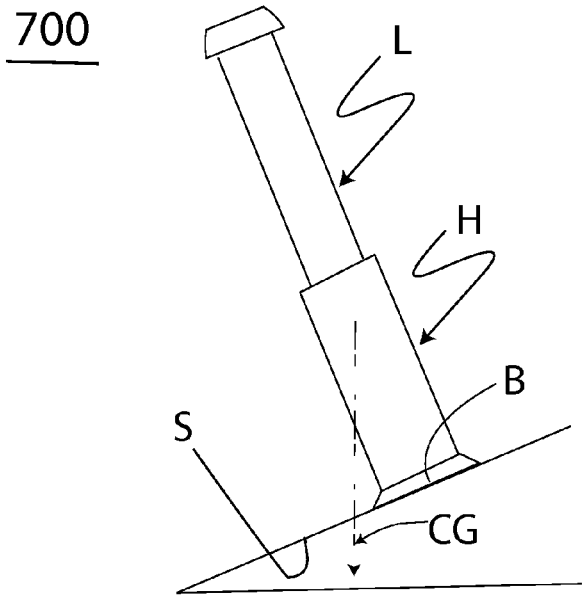
FIG. 8A is a side elevational view of a typical hand held task light rest on the sloped surface, the center of gravity of the task light will be shifted beyond the base of the task light and the light will topple which is not indicated in the drawing.
Figure 8B:
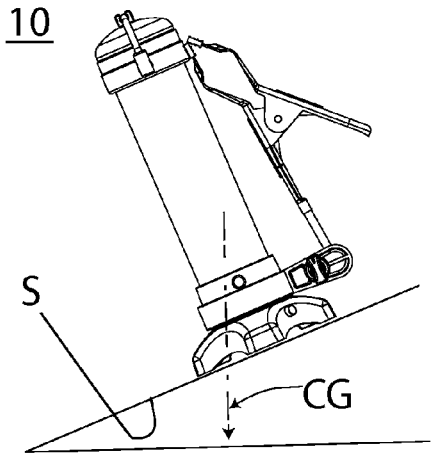
FIG. 8B is a side elevational view of the invention illustrating the center of gravity of the invention is still within the base of the invention resting on a sloped surface.
Figure 8C:
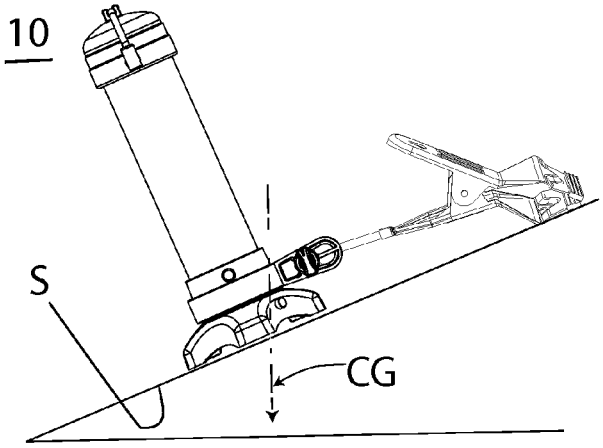
FIG. 8C is a side elevational view of the invention illustrating the adjustment of the clamp enhances the stability of the invention on the sloped surface further by shifting the center of gravity of the invention towards the center of the base.

FIG. 7A illustrates an example of prior art 700 which comprises of a light emitting area L, and a handle H further comprising of a prior art base B. An example of prior art 700 is typically held in the hand during use as illustrated in FIG. 7B and has limited function as a hands free light due to the small size of the prior art base B relative to the height of the overall unit as shown. To illustrate this, a sloped surface S is shown in FIG. 8A which slopes up 20 degrees from horizontal. Upon this surface, the center of gravity CG of said example of prior art 700 falls outside the footprint of the prior art base B causing the example of prior art 700 to topple. In FIG. 8B the hands-free multi-positional task light 10 is shown upon the sloped surface S and the center of gravity CG is seen to remain within the extents of the footprint of base 40 causing the luminaire to remain stable. Through pivoting the clamp 200 so that the jaws of said clamp 200 are contiguous to the sloped surface S, the center of gravity CG is shifted even further which provides stability at even steeper slopes than the 20 degrees described by the sloped surface S.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

The invention claimed is:

1. A portable luminaire assembly comprising:

a clamp;

a circumferential collar comprising a pivot receiver, wherein the clamp is pivotably secured to the collar pivot receiver, wherein the clamp is capable of vertical freedom of movement with respect to the collar, and wherein the clamp is capable of 360 degree rotational freedom of movement with respect to the collar; and an elongated housing comprising a translucent tube extending along a longitudinal axis, a base and an elongated lamp; wherein the base is positioned perpendicularly with respect to the elongated housing longitudinal axis, wherein the elongated lamp extends within the translucent tube and projects light through the translucent tube in a single perpendicular direction with respect to the elongated housing longitudinal axis, wherein, said circumferential collar is rotatably secured about the elongated housing, wherein said base comprises a width along at least one horizontal axis that is greater than the translucent tube width, wherein the base is capable of supporting the elongated housing and the clamp in a vertical position with respect to a predetermined surface.

2. The assembly of claim 1, wherein said elongated housing comprises a center of gravity providing stability on a 20 degree surface while said clamp is secured to said collar.

3. The assembly of claim 1 wherein said elongated housing contains a rotatable hook capable of supporting said portable luminaire assembly.

4. The assembly of claim 1 wherein said elongated housing contains a retractable hook capable of supporting said portable luminaire assembly when extended.

5. The assembly of claim 1 wherein said portable luminaire assembly further comprises a power source disposed within the elongated housing.

6. The assembly of claim 1 wherein said clamp further comprises at least two rigid planes adjustably connected at a common hinge point.

7. The assembly of claim 1 wherein said clamp is pivotably secured to the collar pivot receiver with a transition arm and a rotatable joint; wherein said circumferential collar is slidably disposed around said elongated housing such that said circumferential collar can slide parallel along the length of the longitudinal axis of said elongated housing and said rotatable joint is contiguous with said clamp.

8. The assembly of claim 7 wherein said pivot receiver is a ball-and-socket joint, wherein the ball-and-socket joint provides 360 degree rotation and up to 200 degree of vertical tilt adjustment.

9. The assembly of claim 1, wherein said elongated housing further comprises a circumferential guide, wherein said collar is rotatably secured about the elongated housing with respect to the circumferential guide.

10. A method of illuminating an area, comprising the steps of:

providing a portable luminaire assembly comprising a clamp, a circumferential collar comprising a pivot receiver, and an elongated housing, wherein said elongated housing comprises a translucent tube extending along a longitudinal axis, a base and an elongated lamp; wherein the base is positioned perpendicularly with respect to the elongated housing longitudinal axis, wherein the elongated lamp extends within the translucent tube and projects light through the translucent tube in a single perpendicular direction with respect to the elongated housing longitudinal axis; wherein the elongated housing comprises a circumferential groove;

wherein, said collar is secured with respect to the circumferential groove; wherein, said circumferential collar is rotatably secured about the elongated housing, wherein said base comprises a width along at least one horizontal axis that is greater than the translucent tube width, wherein the base is capable of supporting the elongated housing and the clamp in a vertical position with respect to a predetermined surface;

removably securing said clamp onto another object;

adjusting said elongated lamp towards the area; and activating the elongated lamp.

11. The method of illuminating of claim 10, wherein said elongated housing comprises a center of gravity providing stability on a 20 degree surface while said clamp is attached to said outer housing.

12. The method of illuminating of claim 10, wherein the pivot receiver comprises a ball-and-socket joint, wherein the ball-and-socket joint provides 360 degree rotation and up to 200 degree of vertical tilt adjustment.

13. The method of illuminating of claim 12, wherein said collar can rotate around the longitudinal axis of said outer housing.

* * * * *